United States Patent [19]

Löthman

[11] Patent Number: 4,510,732

[45] Date of Patent: Apr. 16, 1985

[54] MACHINE FOR THE PROCESSING OF PACKING CONTAINERS

[75] Inventor: Stig A. Löthman, Veberöd, Sweden

[73] Assignee: Tetra Pak International AB, Lund, Sweden

[21] Appl. No.: 360,562

[22] Filed: Mar. 22, 1982

[51] Int. Cl.[3] ..... B65B 7/20

[52] U.S. Cl. ..... 53/168; 53/383; 53/378; 53/381 R; 493/218; 493/247; 493/936

[58] Field of Search ..... 53/168, 202, 379, 378, 53/381 R, 383, 482; 493/218, 247, 936

[56] References Cited

U.S. PATENT DOCUMENTS

| | | | |
|---|---|---|---|
| 1,868,686 | 7/1932 | Belcher | 53/378 X |
| 2,196,666 | 4/1940 | Moore | 53/482 X |
| 2,229,864 | 1/1941 | Moore | 53/482 X |
| 2,460,751 | 2/1949 | Irvine | 53/378 |
| 2,587,663 | 3/1952 | Socke | 53/378 X |
| 2,677,924 | 5/1954 | Coakley | 53/378 |
| 2,723,516 | 11/1955 | Malhiot | 53/381 R X |
| 3,391,520 | 7/1968 | Albrecht | 53/202 |
| 3,438,176 | 4/1969 | Reil | 53/379 |
| 3,605,380 | 9/1971 | Dille | 53/202 |
| 3,831,343 | 8/1974 | Dominici | 53/381 R X |

FOREIGN PATENT DOCUMENTS

| | | |
|---|---|---|
| 1247192 | 8/1967 | Fed. Rep. of Germany . |
| 2337939 | 2/1975 | Fed. Rep. of Germany . |
| 2544024 | 4/1977 | Fed. Rep. of Germany . |
| 2217218 | 9/1974 | France . |
| 2326333 | 4/1977 | France . |

*Primary Examiner*—John Sipos

*Attorney, Agent, or Firm*—Burns, Doane, Swecker & Mathis

[57] ABSTRACT

A machine for the processing of packing containers of the type used for example for milk products. Such packing containers are manufactured from a filled material tube and are first given cushion-shape. With the help of the machine in accordance with the invention they are subsequently converted to a substantially parallelepipedic shape.

The machine comprises a means of transport in the form of a wheel (35) having radial holding devices (37) for the cushion-shaped semi-finished products (2). The means of transport can be rotated step-by-step so that each individual packing container passes around processing stations (45–50) placed around the periphery of the means of transport for the folding of corner lugs, sealing and shaping.

33 Claims, 13 Drawing Figures

MACHINE FOR THE PROCESSING OF PACKING CONTAINERS

BACKGROUND AND SUMMARY OF THE PRESENT INVENTION

The present invention relates generally to a machine for the processing of packing containers. More specifically, the present invention concerns a processing machine having drivable means of transport for the moving of the packing containers between different processing stations.

In the manufacture of non-returnable packages for liquid dairy goods and the like, a material web of a flexible, but relatively shape-retaining, laminated material is used which includes layers of paper, thermoplastics and possibly aluminum foil. The material web is supplied in the form of a roll to a packing machine which successively converts the material web to a tube or hose by sealing the longitudinal edges of the web to one another. This liquid-tight tube is filled with contents, whereupon it is divided into individual, substantially cushion-shaped packing containers by compression and sealing together along zones situated at equal distances, extending transversely over the material tube. The packing containers so obtained are formed in conjunction with the compression and sealing together to substantially parallelepipedic units, which are separated from each other by cuts in the transverse sealing zones. The parallelepipedic shape is disturbed, however, by the sealing zones converted to projecting sealing fins as well as by four triangular, double-walled corner lugs which for reasons of geometry are formed of excess material during the conversion from cushion-shape to substantially parallelepipedic shape.

Each individual packing container is then conveyed further to a machine, possibly built together with the main packing machine, for the processing (so-called final shaping or final folding) of the packing containers. In such a machine, among other things, the sealing fins as well as the corner lugs are folded in against and jointed to the container body proper so that a packing container of a more correct parallelepipedic shape is produced.

This processing or final folding of each individual packing container manufactured by the packing machine takes place successively as each packing container is moved between and is processed in different processing stations in the final folder. The time for the whole processing cycle is determined, among other things, by the heat-sealing times of the thermoplastic material, which renders it difficult to design a final folder which operates at sufficiently high speed to serve fast packing machines.

The movement of the more or less finished packing containers step-by-step also makes high demands on accuracy, if it is to be ensured that each packing container is moved to the exactly correct processing position at each station.

Previously used final folders cannot process the packing containers with sufficient accuracy and safety at the high speeds of operation which are required in modern packing machines, and it is therefore in general desirable that a faster and more accurately working final folder should be designed.

It is an object of the present invention therefore to provide a machine for the processing of packing containers, this machine not being subject to the disadvantages of earlier designs, but working safely and rapidly.

It is a further object of the present invention to provide a machine of the abovementioned type which safely moves and guides the packing containers between accurately fixed positions in each processing station.

It is a still further object of the present invention to provide a machine which is capable of performing a safe and accurate folding and forming of sealing fins as well as corner lugs.

It is a yet further object of the present invention finally to provide a final folder which in spite of making it possible to extend the processing time in each individual processing station has a high overall capacity.

These and other objects have been achieved in accordance with the invention by a machine of the type mentioned earlier in which the means of transport includes intermittently rotating support means or a drum which along its periphery is provided with holding means or devices for individual packing containers. The holding devices are arranged at a mutually uniform pitch which corresponds to the pitch between the processing stations fixed around the means of transport, and are adapted so that during rotation of the means of transport they are maneuvered between an open and a closed position.

Preferred embodiments of the machine in accordance with the invention have been given the characteristics which are evident from the description below.

Through this design of the machine in accordance with the invention, a machine for the processing or final folding of packing containers is provided which not only brings about a very high working speed, but also makes it possible to increase the available processing time at each station. At the same time, the machine guarantees a safe removal of the partially processed packing containers between accurately fixed positions at each processing station. The machine in accordance with the invention also provides a safe guidance of the packing containers during the transport between the processing stations and ensures finally that the folding-in of the corner lugs is taking place step-by-step in a well-defined and accurate manner.

BRIEF DESCRIPTION OF THE DRAWINGS

A preferred embodiment of the machine in accordance with the invention will now be described in greater detail with special reference to the enclosed drawings which show schematically a preferred embodiment of the machine in accordance with the invention where for the sake of clarity only the details required for the understanding of the design and function of the machine have been included in the different figures.

DETAILED DESCRIPTION OF THE PREFERRED EMBODIMENTS

Figure 1:
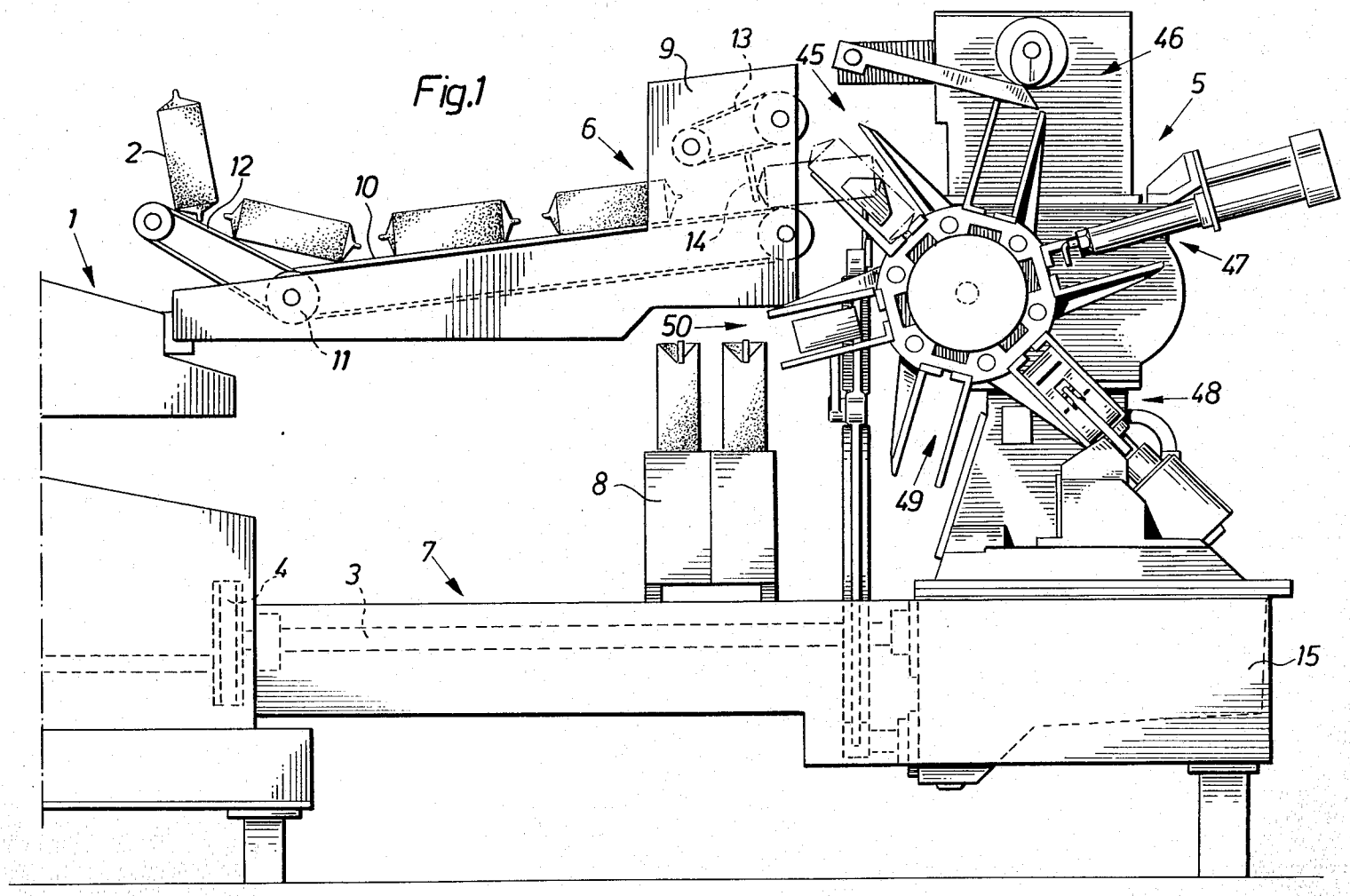
FIG. 1 is a side elevational schematic view of the machine in accordance with the invention as arranged at and coupled to a packing machine of the conventional type.

In FIG. 1 is schematically illustrated a preferred embodiment of the machine in accordance with the invention. The machine is arranged at and connected to a conventional packing machine, of which only a limited part 1 is shown in the figure. The machine in accordance with the invention is adapted to take in hand and to finish packing containers 2 delivered from the packing machine 1 and it is driven synchronously with the packing machine 1 by a driving shaft 3 which connects the machine in accordance with the invention to a power take-off 4 in the packing machine.

For a graphic description of the machine in accordance with the invention it may be divided into three main units, namely a final folding unit 5 proper wherein the successive processing of the packing container taken in hand is taking place, a transportation unit 6 for the conveying of the packing container 2 from the packing machine 1 to the final folding unit 5, and a power transmission and driving unit 7 for the driving of the final folding unit 5 and the conveying unit 6 synchronously with the packing machine 1. The power transmission and driving unit 7 is situated lowermost in the machine and constitutes at the same time a foundation for the other units. The transportion unit 6 is situated between the packing machine 1 and the final folding unit 5, space being provided underneath the transportation unit 6 for a conveyor 8 mounted above the driving unit 7. The conveyor 8 extends right-angled to the transportation unit 6 and is adapted for the removal of finished packing containers 2 from the final folding unit 5 for the further transport to a packer which collects a number of individual packing containers 2 into a larger collective package in order to facilitate the further transport to the consumer.

The transportation unit 6 includes a frame 9 which has two parallel elongated sidewalls between which the packing containers are conveyed from the packing machine 1 to the final folding unit 5 by an endless main conveyor belt 10. The main conveyor belt 10 moves around pulleys, arranged at both ends of the conveying unit 6, and which are supported so that they can rotate freely between the two parallel sides of the frame 9. The end pulley 11 is connected to a driving motor (not shown) and serves at the same time as an end pulley for a further conveyor belt 12 which is designed as a receiving conveyor belt for the packing containers delivered from the packing machine 1. The receiving conveyor belt 12 as well as the main conveyor belt 10 include a great number of parallel belts which are arranged with gaps between them, sufficient to allow them to pass over the common end pulley 11 without interferring with each other.

The main conveyor belt 10 extends substantially horizontally or slightly upwards towards the final folding unit 5, while the receiving conveyor belt 12 slopes in the opposite direction and, more particularly, extends upwards towards the packing machine 1 at an angle to the horizontal plane which amounts to approx. 30°. As a result the partially formed packing containers, fed-out from the packing machine 1 will, after a short distance of free fall, land and be checked gently by the sloping conveyor belt 12, whereupon they are transferred directly to the main conveyor belt 10 to be moved on in the direction of the final folding unit 5. At the end of the main conveyor belt 10 facing toward the final folding unit 5 is a feeding-out conveyor belt 13 situated above the main conveyor belt 10. The feeding-out conveyor belt 13 moves in the same main direction as the main conveyor belt 10, but is situated at a distance above the same which substantially corresponds to or slightly exceeds the height of the packing containers transported on the main conveyor belt 10. While the main conveyor belt 10 and the receiving conveyor belt 12 are driven at a uniform, constant speed, the feeding-out conveyor belt 13 is driven at a constant speed which is twice the speed of the main conveyor belt 10. With the help of a finger 14 projecting from the conveyor belt 13 the feeding-out conveyor belt 13 takes over the feed of the packages arriving on the main conveyor belt 10 and moves the same at twice the speed over the final stretch from the main conveyor belt 10 and over to the final folding unit 5. As a result the packages transferred successively to the final folding unit 5 will be "separated" so that the interval between them becomes greater than the interval between the packing containers fed along the main conveyor belt 10. This is important for the function of the final folding unit, as will be explained in more detail in the following.

The power transmission or driving unit 7 located underneath the transportation unit 6 extends from the lower end of the packing machine 1 and in, underneath the final folding unit 5 proper. The power transmission unit 7 includes an open part, shown to the left in FIG. 1, wherein runs the driving shaft 3 which connects the power takeoff of the packing machine 4 to a closed transfer gearbox 15, shown on the right in FIG. 1. This at the same time constitutes the foundation for the final folding unit 5. The open part of the power transmission unit 7 includes two parallel sides and a base and in the main has three functions, namely in the first place to prevent contact with the driving shaft 3, secondly to fix the final folding unit at a correct distance from the packing machine 1 and thirdly to serve as a collecting trough for liquid contents which e.g. may leak from the packing containers. The driving shaft 3 connects via suitable couplings and gearboxes (not shown) the driving motor to the packing machine to the driving system of the final folding unit 5, so that the final folding unit automatically can be driven synchronously with the packing machine. It is also possible to drive the final folding unit 5 by a separate driving motor (not shown) which makes possible, for example, operation of the final folding unit 5 and the transportation unit 6 after the main packing machine 1 has been stopped.

Figure 2:
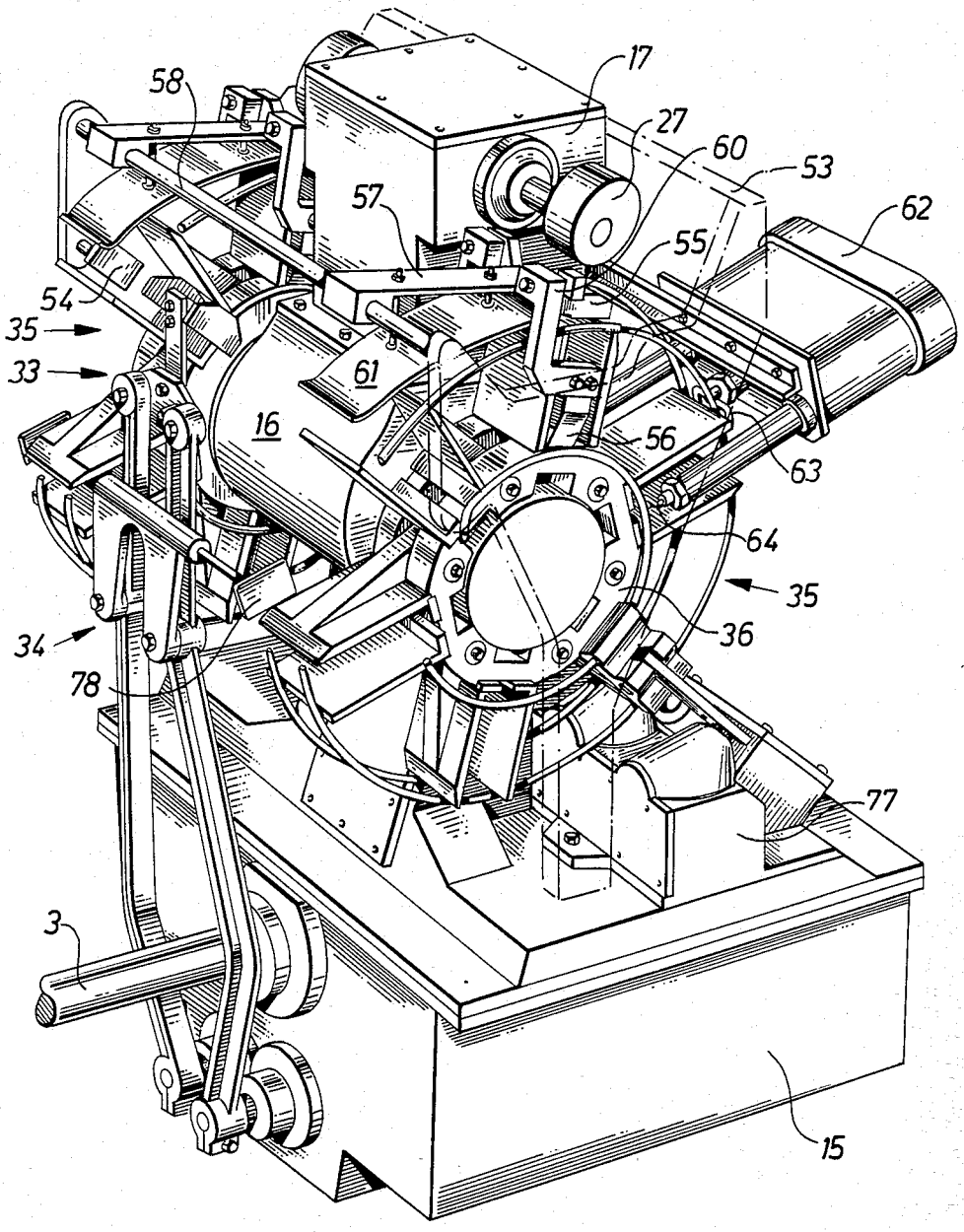
FIG. 2 is a perspective view of the main unit or final folding unit of the machine in accordance with the invention.
Figure 3:
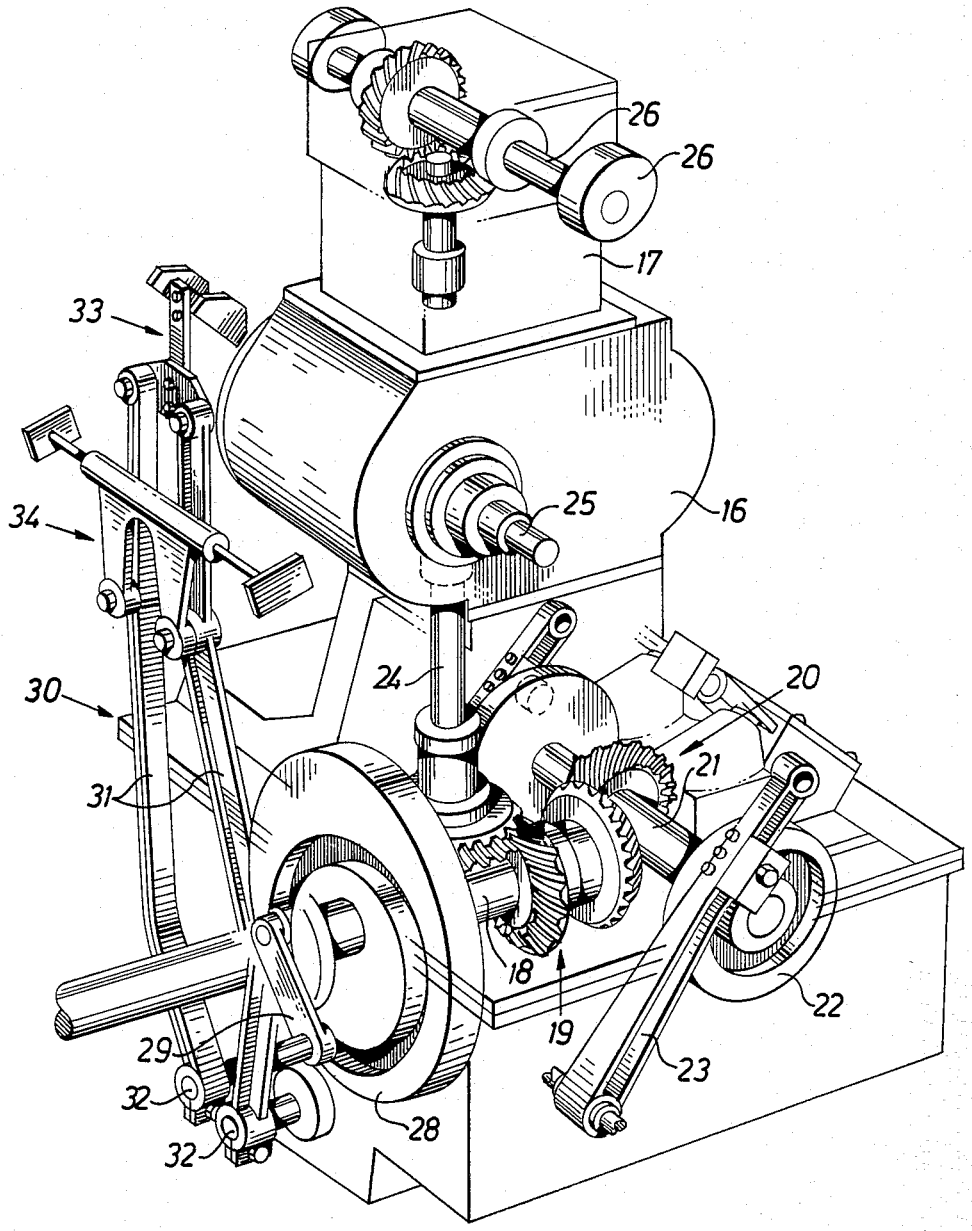
FIG. 3 is a perspective view of the folding unit of FIG. 2 with some elements removed to illustrate the driving system of the final folding unit.

The actual main portion of the machine in accordance with the invention, that is to say the final folding unit 5, has a foundation which in its lowest part accomodates the transfer gearbox 15 mentioned earlier. Above this there is a second gearbox which includes an indexing gear 16 (FIG. 2), and above this there is a further gearbox including an upper mitre gear 17. The driving shaft 3 extending through the power transmission unit 7 is connected via a coupling to an incoming shaft 18 in the transfer gearbox 15 (FIG. 3). The incoming shaft 18 runs horizontally into the transfer gearbox and drives a lower mitre gear 19 and a rear mitre gear 20. The rotation of the incoming shaft 18 is transferred via the rear mitre 20 to a lower shaft 21 also situated horizontally but at a right angle to the incoming shaft 18. The incoming shaft 18, via operating cams 22 at both its ends, converts the movement to a reciprocating oscillating motion of two operating arms 23 mounted so that they can oscillate in the transfer gearbox. The function of the gearing will be described in detail in the following.

The rotation of the incoming shaft 18 is transmitted further via the lower mitre gear 19 mentioned earlier to a transfer shaft 24 extending vertically through the final folding unit 5. The transfer shaft 24 drives the indexing gear 16 via a mitre gear so that the rotation of the transfer shaft 24 is converted to a repeated turning movement or indexing of 1/6th turn of an intermediate shaft 25 projecting on either side of the indexing gearbox. From the indexing gearbox the rotation is transferred via a further cutout by way of the upper mitre gear 17 to a horizontally situated upper shaft 26 which is provided on both ends with cams 27, the function of which will be described in the following.

The incoming shaft 18 is also provided, finally, with a feed cam plate 28 which via a cam follower 29 drives a feed assembly 30 mounted so that it can oscillate outside the transfer gearbox. The feed assembly 30 includes two substantially vertical arms 31 extending on either side of the driving shaft. The arms 31 are supported by two parallel shafts 32 which are both supported so that they can rotate at the end wall of the transfer gearbox 15. However, one of the shafts 32 extends with its one end into the transfer gearbox where it supports the cam follower 29. Via this shaft the feed assembly 30 can be actuated in a reciprocating oscillating movement. The two oscillating arms 31 support at their upper part a feeding-in device 33 and a feeding-out device 34 which are in parallelogram suspension in the arms 31. The function of the two feeding devices 33,34 will be described in the following.

The transfer gearbox 15 is designed as an oil trough and partially filled with oil which is supplied by pumps (not shown) to the different movable parts located in the final folding unit such as shafts, mitre gears etc. To prevent any oil leakage and contamination of the packing containers handled in the final folding unit 5, the driving system mentioned above and described in connection with FIG. 3 is wholly closed.

Figure 4:
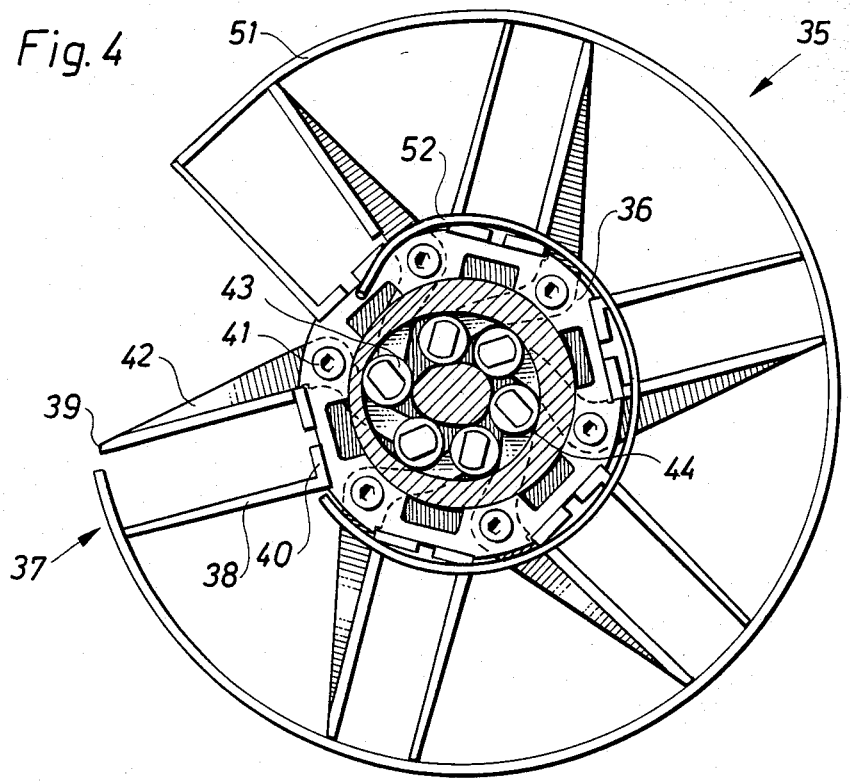
FIG. 4 is a side elevation view of means of transport mounted on the final folding unit.

The machine will now be described in detail with special reference to FIG. 2 which shows the final folding unit 5 itself in perspective. It is evident from the figure how the foundation described earlier, consisting of the transfer gearbox 15, the indexing gear 16 and the upper mitre gear 17, supports two rotatable means of transport 35. The two means of transport 35 each include a centrally situated rotatable drum 36 which is firmly attached to an end of the intermediate shaft 25 projecting from the indexing gearbox housing 16. The two means of transport 35 are mutually identical (so that in the following only one will be described) and are situated axially in line with one another on either side of the indexing gearbox 16. It is the task of the means of transport 35 to remove the packing containers supplied via the transportation unit 6 (FIG. 1) between different processing stations in the final folding unit. The means of transport is provided to this end with a number of holding devices 37 situated at a uniform pitch around the drum 36. Each holding device 37 includes a fixed and a movable jaw, 38 and 39 respectively, (FIG. 4) which between substantially plane working surfaces facing towards each other form a space adapted to the size of the packing container 2. Each fixed jaw 38 is substantially L-shaped, the longer leg of the L forming the working surface which extends substantially radially in relation to the drum 36 while the shorter leg extends at an angle of 90° to the working surface so that the shorter leg in effect forms the base 40 of the holding device 37. In the base a cutout is provided to accomodate a sealing fin on the packing containers. The fixed jaw 38 is firmly attached with its shorter leg to the drum 36. The movable jaw 39 is supported so that it can pivot about an axle 41 extending parallel with the center axle of the drum. More particularly, the jaw 39 supported pivotably consitutes one arm of a lever 42, the other arm of which supports a cam follower 43 which is permanently engaged with a fixed double cam 44 situated centrally in the drum 36. On rotation of the means of transport 35, the cam 44 will via the cam follower 43 and the lever 42 act upon the movable jaw so that it is moved between a closed position, wherein the plane working surface of the jaw 39 extends parallel in relation to the working surface (longer leg) of the fixed jaw 38, and an open position, wherein the movable jaw 39 is pivoted out at an angle of substantially 10° with the fixed jaw 38. This will be explained in more detail in the following description of the function of the machine.

Distributed around the means of transport 35 are a number of processing stations which are arranged at a mutual pitch which corresponds to the pitch between the holding devices 37 of the means of transport. As is evident most clearly from FIG. 1, a feeding-in station 45 is present at the end of the transportation unit 6 which is followed by a prefolding station 46 situated substantially above the center axle of the means of transport 35. After the prefolding station 46 follows an adhesive station 47, a final folding station 48, a stand-by station 49 not utilized at present and a feeding-out station 50. The different stations have been listed here in the sequence in which they are reached during the operation of the machine by an individual packing container moved by the means of transport 35. The means of transport 35 is thus indexed during operation step-by-step clockwise in FIG. 1, each movement corresponding to a turn which agrees with the pitch angle between the different stations (60°).

Beside the different processing stations each means of transport 35 is also surrounded by a number of guide rails (FIG. 4) which are fixed in relation to the foundation of the machine, and adapted to guide and process the packing containers moved by the means of transport. Each means of transport 35 co-operates with two different types of guide rails, namely on the one hand outer guide rails 51 which extend around the means of transport substantially at the same level as the outer ends of the holding devices 37, and inner guide rails 52 which extend around the means of transport substantially at the same level as the base surfaces 40 of the holding devices 37. The outer as well as the inner guide rails are double and are situated on either side of the means of transport 35, which is seen most clearly from FIG. 2. The guide rails 51,52 are attached to sides of a frame 53 situated outside the means of transport 35 which in turn is rigidly joined to the foundation of the machine. The stand 53 is illustrated, for reasons of clarity, only be dash-dotted lines in FIG. 2. The guide rails 51,52 are thus fixed and therefore do not follow the means of transport 35 during its indexing movement.

The two outer guide rails 51 commence at the same level as the feeding-in station and extend substantially from there past the prefolding station and further round the means of transport to finish at the feeding-out station. The distance between the two guide rails 51 and the center axle of the means of transport 35 varies inasmuch as the guide rails 51 at the same level as the feeding-in station 45 are nearer to the center axle of the means of transport than they are during the remainder of their extension around the means of transport. More particuarly, the distance between the guide rails 51 and the center axle of the means of transport is increased successively on the extension between the feeding-in station and the prefolding station, to be diminished again thereafter. In this way the guide rails approach the periphery of the means of transport and run at substantially constant distance during the remaining extension of the guide rails to the feeding-out station. As a result, during the first extension of the guide rails, the distance between the guide rails 51 and the base surfaces 40 of the holding devices 37 will be increased successively, seen in the direction of movement of the holding device 37, from a distance which is less than the height of the holding device 37 to a distance which, at the same level as the prefolding station 46, is greater than the height of the holding device 37. Subsequently the guide rails 51 approach the height of the holding device again and thereafter continue at this level right to the feeding-out station. The mutual distance between the two guide rails also varies. During the said first part of the extension of the guide rails, that is to say between the feeding-in station and the prefolding station, the distance between the guide rails 51 is slightly greater than the width of the holding device 37, that is to say the distance between the lateral surfaces of the jaws 38,39 measured parallel with the center axle of the means of transport 35. During the extension from the feeding-in station to the prefolding station this distance is successively reduced, at the same time as the guide rails 51, as mentioned previously, move away more and more from the center axle of the means of transport 35, and the mutual distance between the guide rails 51 has been reduced at the level of the prefolding station 46 so that the distance between the surfaces of the guide rails 51 facing each other largely agrees with the distance between the lateral surfaces of the jaws 38, 39. During the continued extension of the guide rails 51 around the means of transport 35, the distance is successively reduced further so that at the level of the adhesive station 47 it is slightly smaller than the distance between the lateral surfaces of the jaws 38,39. This distance is retained substantially during the continued extension of the guide rails 51 up to the feeding-out station.

The two inner guide rails 52 extend similarly to the outer guide rails 51 around the means of transport 35 with the front end level with the feeding-in station 45, or between this and the prefolding station, and the rear end situated before the feeding-out station 50. The two inner guide rails 52, however, are placed appreciably closer the center axle of the means of transport 35 and are therefore situated substantially level with the base surfaces 40 of the holding device 37. The guide rails 52 extend along their whole length at a slight distance outside the lateral surfaces of the two jaws 38,39, that is to say the distance between the surfaces of the guide rails 52 facing towards each other is slightly greater than the width of the jaws 38,39. The width of the jaws 38,39 is intended, here as well as in other parts of the description and the claims, to mean the distance between the lateral surfaces of each jaw facing from each other, which distance substantially corresponds to the width of a packing container handled. The height of a holding device is intended, moreover to mean the distance from the base surface of the holding device facing towards a packing container to the outer end of the jaws 38,39. In other words the height of the holding device 37 substantially corresponds to the height of a processed packing container.

The front ends of the two guide rails 52 are situated at the feeding-in station at a distance from the center axle of the means of transport which is slightly smaller than the distance between the base surface 40 of the holding device and the center axle, that is to say the guide rails 52 are a little "below" the base surface 40 of the holding device. From the feeding-in station 45, thereafter, the distance between the two guide rails 52 and the center axle of the means of transport 35 is successively increased so that the guide rails, at the level of the prefolding station 46, are at a slightly greater distance from the center axle than the base surface 40 of the holding device 37. The two guide rails 52 subsequently run at a small distance "above" the base surface 40 during their remaining extension up to the rear end.

The outer guide rails 51 as well as the inner guide rails 52 preferably consist of metal tube, through which a cooling medium e.g. water can be made to circulate during the operation of the machine. As mentioned earlier, a number of fixed processing stations are provided around the means of transport 35 between which stations the packing containers are adapted to be moved during processing and forming intermittently with the help of holding devices of the means of transport. During the rotation of the means of transport 35 the movable jaws 39 of the holding devices are acted upon through engagement of the cam followers 43 with the cam 44 between the open and closed position. In the open position the movable jaw is in a slightly pivoted-out position in relation to the fixed jaw, which brings about the removal of a packing container to or from the respective holding device. In the closed position the two working surfaces of the jaws are substantially parallel and situated at such a distance from each other that they retain between themselves without difficulty a packing container placed into the holding device, even when the holding device is upside down, that is to say at the lower part of the means of transport 35 at the time. To make possible the maneuvering of the movable jaws 39, the cam 44 has a varying radius along its circumference. More particularly, the cam has during substantially one half turn a relatively small radius which increases thereafter to a maximum and subsequently is reduced again to the small radius mentioned earlier. The portion of the cam during which the radius successively diminishes from the maximum to the region with a smaller radius is located so that the holding devices 37 will be in an intermediate position, that is to say they will be partially open when they are in the prefolding station 46. The term "partially open" is to be understood to mean that the holding device certainly retains the packing container between the jaws, but nevertheless allows a certain movement or correction of the position of the packing container in the holding device if the packing container is subjected to external forces. For the rest, the different portions of the cam are located so that during the intermittent rotation of the means of transport, the holding devices are open while they are at the feeding-in and feeding-out stations, and closed while they are at the adhesive and pressing shut stations. In the partially open position, wherein the holding device 37 is at the prefolding station 46, the packing container present in the holding device is certainly enclosed by the two jaws 38,39, but they do not retain the packing container immovably but the packing container can be moved, presenting a certain resistance, under the effect of external forces.

The feeding-in station 45 is situated at a level with the feeding-in device 33 which is supported by the feed assembly 30 and with the help of the same is movable to and fro between the feeding-in stations of the two means of transport 35 so as to make possible the removal of packing containers delivered from the transportation unit 6 along a channel (not shown) extending transversely between the means of transport 35. At the feeding-in station a stop 54 mounted on the side of the frame 53 is also present which is in the shape of a plate situated just in front of the feeding-in device 33 serving for the limitation of the movement of the packing containers and so as to ensure that they end up in correct position in the open holding device. The length of stroke of the feeding device 33 is such that the distance between the feeding-in device and the stop 54 in the turning position of the feeding-in device corresponds to the width of a packing container. This ensures a correct placing and fixing of the packing container between the jaws of the holding device.

Figure 9:
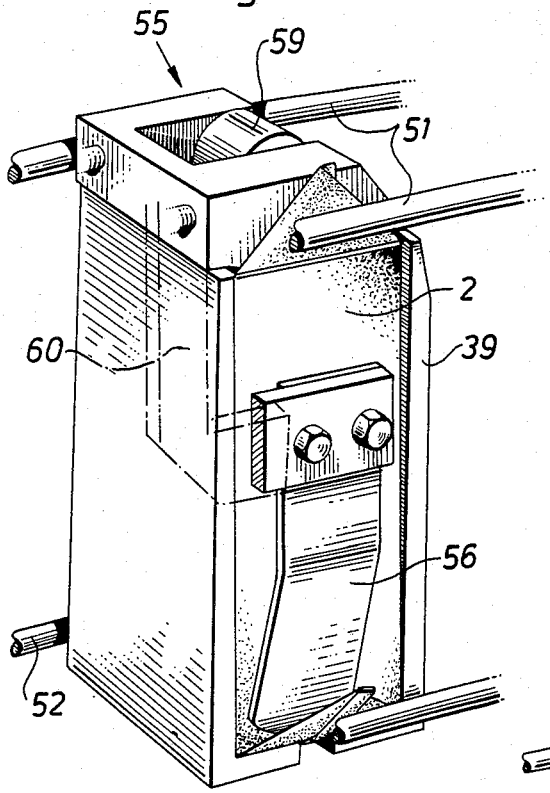

The prefolding station 46 comprises a base folding plate 55 arranged above the holding device situated in the prefolding station and two top folding plates arranged on either side of the holding device (FIG. 9). The base folding plate 55 as well as the top folding plates 56 are supported by a supporting arm 57 which is positioned so that it can freely rotate on a transverse supporting axle 58 which extends parallel with the center axle of the means of transport 35. The base folding plate 55 and the top folding plates 56 are synchronously movable between an upper position and a lower position with the help of the cam 27 mounted on the upper axle 26 which rests against and acts upon a roller 59 supported so that it can rotate in the base folding plate 55 and which by a spring element (not shown) can be pressed against the surface of the cam 27. The base folding plate 55 has a plane working surface facing toward the holding device which in the upper, inactive position of the base folding plate is at a slight distance above the outer (upper) end of the holding device so that during the action of the cam 27 in its active position it is substantially at the same level as the outer edge of the holding device 37, that is to say at the same level as the upper end faces of the two jaws 38,39. In other words, the base folding plate 55 is movable in radial direction of the means of transport from its rest position outside the two guide rails 51 to its active position between the guide rails and the center of the means of transport. The base folding plate 55 is between two and ten millimeters narrower than the free distance between the guide rails 51 at the level of the prefolding station. This dimension is adapted to the thickness of the material of the packing container processed. The reciprocating movement of the base folding plate 55 caused by the cam 27 also imparts a corresponding movement to the two top folding plates 56 situated on either side of the holding device, since these are joined to the supporting arm 57 by intermediate arms 60. The lower ends of the two top folding plates 56, that is to say the ends facing towards the center axle of the means of transport 35 are thus moved between a rest position at a distance above the base surface 40 of the holding device 37 to an active position, substantially at a level with the base surface. The top folding plates 56 are adapted so as to co-operate with the inner guide rails 52, serving as holders-up, which in the prefolding station are situated on either side of the holding device and are a small distance above the base surface 40. Between the feeding-in station 45 and the prefolding station 46 there is a guide plate 61 which is suspended on the supporting arm 57 and is adapted so as to accompany it in its pivoting movement, when the cam 27 moves the base folding plate 55 between its upper and lower position. The guide plate 61 is situated a little outside the outer ends of the holding device 37 and is of a width which substantially corresponds to the width of the base folding plate 55.

The adhesive station 47 in the embodiment of the machine in accordance with the invention is provided with a hot-air assembly 62 which is fixed outside the path of movement of the means of transport 35. The hot-air assembly 62 is of a known type and produces hot air which via pipes and nozzles is supplied to the packing containers located in the adhesive station of the means of transport. More particularly, the hot air is supplied via two bottom nozzles 63 which are located at a slight distance outside the outer boundary surface of the holding device 37, so that they extend in underneath the partially folded down bottom lugs of a packing container fixed in the holding device, and two top nozzles 64, located on either side of the inner end of the holding device, which extend in between the sidewalls of the packing container and the partially folded-in top lugs of the packing container. The bottom nozzles 63 as well as the top nozzles 64 are located outside the path of movement of the means of transport 35 and thus do not obstruct the rotation of the means of transport.

In a second embodiment of the machine in accordance with the invention the hot-air assembly 62 and the hot-air nozzles 63,64 are replaced by a so-called hot-melt assembly, that is to say an assembly for the supply of thermoplastic adhesive to the packing container. The placing of the hot-melt nozzles in this case substantially corresponds to the placing of the nozzles 63, 64, since the hot-melt, like the hot air, is to be applied between the corner lugs of the packing container and the packing container walls against which the corner lugs afterwards are to be folded down. The hot-melt assembly of this type is well known and is not described in any detail.

Figure 5:
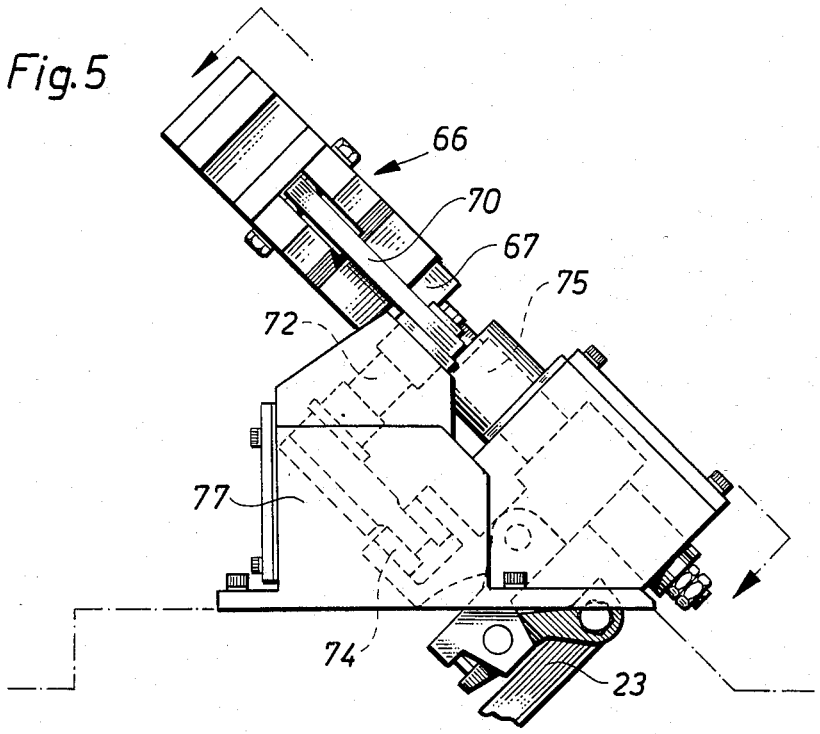
FIG. 5 is a side elevational view of the final folding station of the machine.
Figure 6:
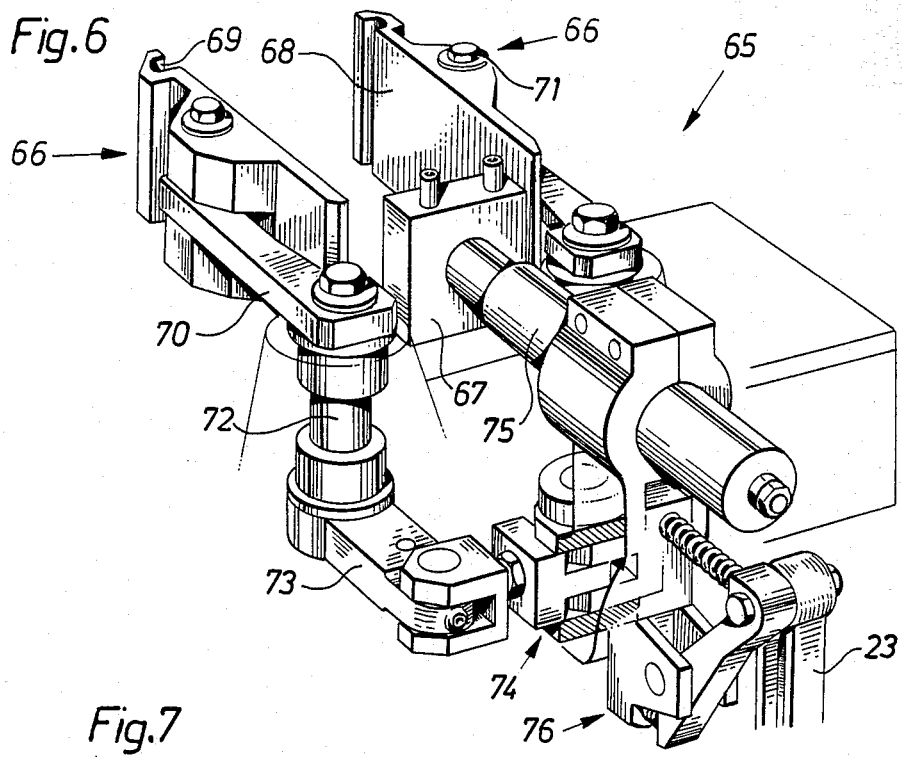
FIG. 6 is a perspective view of the final folding station according to FIG. 5.

The final folding station 48 includes a final folding assembly 65 (FIGS. 5, 6) which is designed for the final folding or final shaping of the packing containers so that they obtain the desired parallelepipedic shape with folded-in and fixed corner lugs. The final folding assembly to this end includes two lateral pressure devices 66 and a bottom pressure device 67 which are adpated so that in their active position, together with the two jaws 38,39 of the holding device and the base 40 of the holding device, they form a practically closed parallelepipedic space whose inner dimension agrees with the desired ultimate dimension of the packing container. The two lateral pressure devices 66 include pressure plates 68 which have working surfaces facing each other. These working surfaces are wholly plane apart from the grooves 69 for the inner guide rails 52. Each one of the pressure plates 68 is supported by a front lever arm 70 to which the pressure plate is connected so that it is able to pivot by a connecting element 71. The connecting element 71 includes rubber grommets and in flexible so that the pressure plate 68 endeavours to assume a position substantially parallel with the lever 70. On contact with the sidewall of the packing container however each pressure plate 68 may pivot against the effect of the flexibility of the connecting element 71 to lie flat against the sidewall.

Each of the two front lever arms 70 is joined via an axle 72 supported in the machine frame to a rear lever arm 73 which is situated inside the transfer gearbox 15. The rear lever arms 73 are connected via a conventional system of links and a toggle joint construction 74 to a maneuvering rod 75 which at its front end carries the bottom pressure device 67. The bottom pressure device 67, which, like the lateral pressure devices 66, has a plane working surface facing towards the packing container, is thus adapted to be brought into contact against the packing container, synchronously with the lateral pressure devices. This is done by one of the two operating arms 23 located in the transfer gearbox 15, which via the operating cams 22 are driven by the lower shaft 21 of the machine.

In order to prevent any damage to the final folding assembly 65 or the means of transport 35 if, for example, the movement is obstructed by foreign objects, a safety clutch 76 is incorporated in the driving system between the operating arm 23 and the final folding assembly 65 proper. The safety clutch 76 is of the known type which automatically trips at a certain load, and does not need to be described in detail. The safety clutch 76 as well as the rest of the driving mechanism for the final folding assembly 65 are located, as is evident especially from FIG. 5, in a bearing housing 77 mounted on the transfer gearbox 15. Outside the bearing housing are present therefore only the two lateral pressure devices 66 and the bottom pressure device 67. These devices 66,67 are adapted so that during the operation of the machine they are moved between an open position or rest position, wherein the lateral pressure devices as well as the bottom pressure device are at such a distance from the means of transport 35 that a holding device 37 can freely pass between them, and an active position, wherein the lateral pressure devices and the bottom pressure device are pressed against a packing container present in the final folding position and fixed by a holding device 37.

The next processing station for a packing container moved by the means of transport 35 is the stand-by station 49 which may be utilized for any desired further processing of the packing container, e.g. the application of reinforcing strips or bands, date stamping or the like.

The feeding-out station 50 is situated right in front of the feeding-out device 34 which is adapted to be moved synchronously with the feeding-in device 33 with the help of the reciprocating arms 31 of the feed assembly. The feeding-out device 34, like the feeding-in device 33, includes pressure plates 78 which are adapted so as to remove the packing container from the holding device 37. The movable jaw 39 of the holding device 37 has been moved in the feeding-out station to its outwards pivoted position with the help of the cam 44. On oscillation of the feed assembly 30, the pressure plate 78 removes one packing container at the time from the holding device 37 to a chute (not shown) situated alongside (outside) the holding device. The chute is adapted to remove the package to the conveyor 8 mentioned earlier, on which conveyor the packing containers, in upright position, are withdrawn from the machine in accordance with invention.

When a machine in accordance with the invention is used together with a packing machine so as to form substantially parallelepipedic packing containers for liquid contents, the machine is placed as shown in FIG. 1, that is to say adjoining a packing machine and connected to the same via the power transmission and driving unit 7. When the packing machine proper is started, the machine in accordance with the invention will also be started, since it is driven with the help of the driving assembly of the packing machine. The packing containers or packing container blanks coming from the packing machine proper, which are wholly filled and closed, leave the packing machine, after they have been separated from the tube from which they have been manufactured, and are allowed to drop down onto the receiving conveyor belt 12. This conveyor belt 12 thanks to its angle with the horizontal plane, checks the packing containers gently and transfers them to the main conveyor belt 10, on which they are fed at short mutual intervals in the direction of the final folding unit 5. When an individual packing container approaches the rear end of the main conveyor belt 10, the feed is taken over by the feeding-out conveyor belt 13 which is driven at substantially twice the speed compared with the main coveyor belt 10. The finger 14 of the feeding-out conveyor belt 13 will engage with the individual packing container and remove it from the rear end of the main conveyor belt 10 to the transverse feeding-in channel along which the feeding-in device 33 performs its reciprocating movement. The feeding-out conveyor belt 13 is synchronized with the movement of the feeding-in device 33 is such a manner that it is always in one of its turning positions when a packing container is delivered to the channel. On removal of the feeding-in device 33 to its opposite end position, the packing container fed-in is pushed via the channel to one or other of the holding devices 37 of the two means of transport 35 located at the feeding-in station, where the packing container is retained in the right position by the stop 54.

Figure 7:
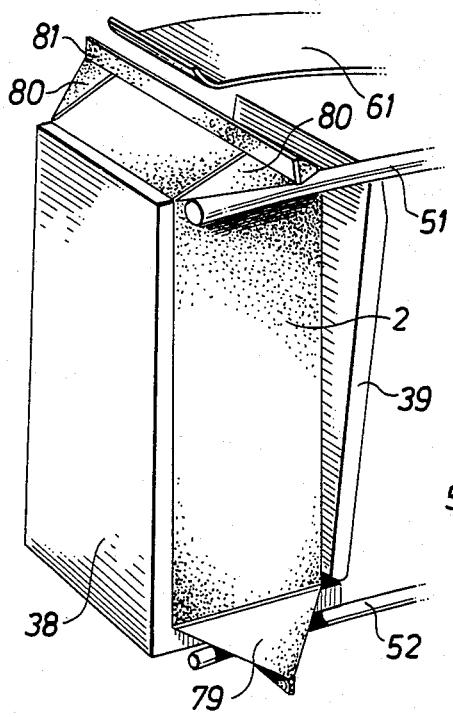
FIGS. 7–13 are enlarged perspective views of the processing and forming of a packing container during its travel through the machine in accordance with the invention, FIG. 7 showing the package in a feeding-in station, FIG. 8 showing the package during its removal from the feeding-in station, FIG. 9 showing the package in a prefolding station, FIG. 10 showing the package in an adhesive station, FIG. 11 showing the package in a final folding station, FIG. 12 showing the package in a ready-shaped condition after the final folding station and FIG. 13 showing the finished packing container in a feeding-out station, where it is discharged from the means of transport of the final folding unit.

The holding device 37 is dimensioned so that the packing container 2 placed therein rests with its bottom surface against the base of the holding device at the same time as its projecting top and bottom corner lugs 79 and 80 (the packing container is upside down in FIG. 7) rest against the two inner guide rails 52 and one of the outer guide rails 51. The movable jaw 39 is in its open position at a slight distance from the sidewall of the packing container, and the guide plate 61 is at a distance from the projecting sealing fin 81 of the packing container. Directly before the means of transport 35 is indexed again, the end of the guide plate 61, visible in FIG. 7, will be lowered towards the sealing fin 81, since the base folding plate 55 at the same time is restored to its rest position in the prefolding station.

Figure 8:
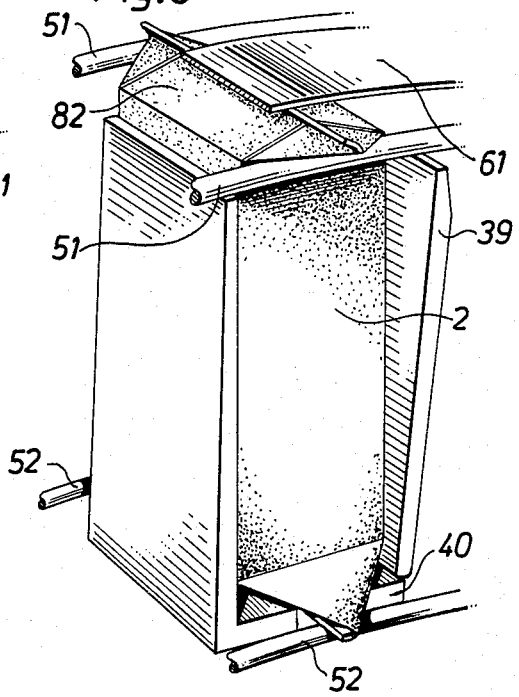

When the guide plate 61 has been moved in the direction towards the sealing fin 81, the means of transport 35 is indexed (clockwise in FIG. 2) so that the packing container 2 is made to glide along the guide rails 51,52 from the feeding-in station in the direction of the prefolding station 46. FIG. 8 illustrates the packing container and the holding device in an intermediate position between these two stations, that is to say during the movement of the packing container to the right in the figure. The guide plate 61, by resting against the sealing fin 81, has folded it down in the direction of the bottom surface 82 of the packing container. As mentioned earlier, the packing container is not fixed immovably in the holding device until the same has passed the prefolding station, and in the position shown in FIG. 8 the movable jaw 39 continues to be at a distance from the sidewall of the packing container, so that the packing container can be moved freely in the holding device and be steered by the guide rails 51,52. Since the latter 51,52 in the region between the feeding-in station and the prefolding station successively increase their radius, the packing container will be raised, owing to the engagement between the projecting corner lugs and the guide rails, so that it is clear of the base 40 of the holding device 37. At the same time the sealing fins 81 are folded backwards, seen in the direction of movement of the packing container, owing to the contact with the guide plate 61 and the two inner guide rails 52.

When the indexing movement of the means of transport 35 ceases, the packing container is in the prefolding station 46. In this station the movable jaw 39 partially has to come to rest against the side of the packing container 2, but the packing container is not wholly fixed and may continue to be moved in the holding device 37 (FIG. 9). Owing to the engagement between the guide rails and the corner lugs of the packing container, the packing container is in an upper or outer position wherein its bottom surface 82 is situated directly underneath the working surface of the base folding plate 55 facing towards the packing container which is in rest position. The upper shaft 26 is now made to rotate one turn by the indexing gear 17, when the cams 27 move the base folding plate 55 as well as the top folding plate 56 in the direction of the center shaft of the means of transport 35 and back again. This motion moves the packing container downwards until its bottom surface rests against the base 40 of the holding device 37 and the packing container once more is in the position into which it has been placed in the holding device during the feeding-in stage. Since the guide rails 51,52 in the prefolding station are at a greater distance from the center axle of the means of transport 35 than they were in the feeding-in station 45, the corner lugs 79,80 of the packing container will be folded upwards during this movement, that is to say in the direction away from the center axle on the means of transport 35. The top lugs 79, which are situated at the base surface 40 of the holding device, are folded around the outer ends of the top folding plates 56 so that they form an angle of substantially 45° with the lateral surface of the packing container. The two bottom corner lugs 80 are folded more strongly and, after the movement has been completed, extend vertically upwards, that is to say at an angle of 90° in relation to the bottom surface of the packing container. The folding of the two bottom corner lugs 80 has to take place with simultaneous compression of the material layers in the corner lugs, since ultimately these are to be folded down against and be attached to the bottom surface 82 of the packing container, over which passes the sealing fin 81. This great number of material layers, which have to be folded and pressed together before the corner lugs have been attached in the correct manner to the bottom surface 82, make it imparative that during this prefolding of the corner lugs they are compressed, and especially the parts of the sealing fin 81 passing over them between the sides of the base folding plate 55 and the two outer guide rails 51. This can be done by ensuring that the free distance on either side of the base pressure plate is as small as possible, bearing in mind the thickness of the material. The free distance preferably represents a value which corresponds to the theoretical material thickness in the corner lugs (usually between 1 and 5 mm). After the base folding plate 55 as well as the top folding plates 56 have reverted to their outer rest position, the means of transport 35 is indexed once more (1/6th turn clockwise), which brings the packing container from the prefolding station to the adhesive station 47. During this removal the holding device 37 is closed, since the movable jaw 39 is moved to a position parallel with the fixed jaw 38 so that the packing container is held immovably in the holding device. Since the distance between the two outer guide rails 51 is slightly reduced in the region between the prefolding station and the adhesive station, the two bottom lugs 80 will be folded a little further towards each other so that when the packing container reaches the adhesive station 47 they form an angle of approx. 45° with the bottom surface 82.

Figure 10:
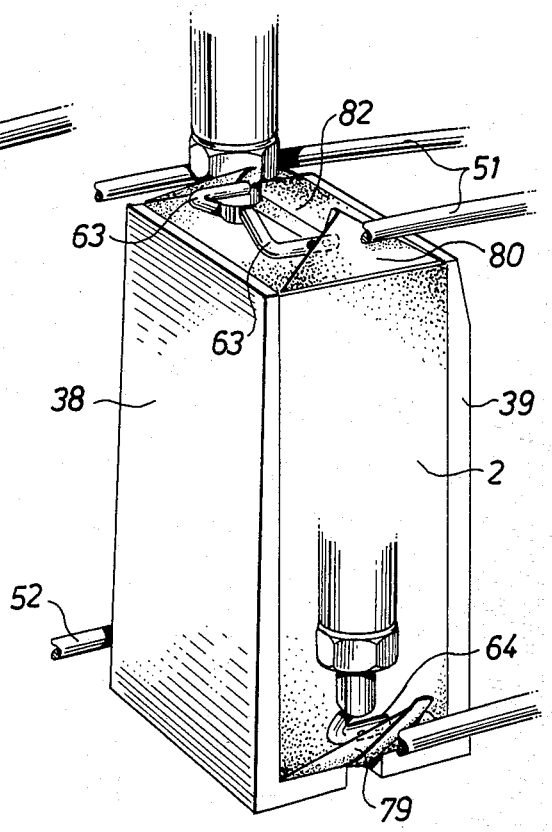

When the holding device 37 stops in the adhesive station, the packing container 2 is in such a position that the bottom nozzle 63 of the hot-air assembly is in the space between the partially folded down bottom corner lugs 80 and the bottom surface 82 of the packing container (FIG. 10). At the same time the top nozzles 64 of the hot-air assembly 62 are on either side of the upper end of the packing container facing towards the base 40 of the holding device. More particularly, the top nozzles 64 are located between the partially folded-in top corner lugs 79 and the free lateral surfaces of the packing container. With the help of discharge holes of the nozzles 63,64, directed towards the corner lugs as well as against the packing container walls, hot air is now blown against the surface of the packing container material in the region underneath the corner lugs which is to be made use of for the attachment of the corner lugs to the underlying packing container wall. As a result the thermoplastic layer on the packing container is heated to such an extent that it melts and can serve as an adhesive for the attachment of the corner lugs. After heating to the softening temperature of the thermoplastic material, the packing container is removed by the transport 35 until it is in the final folding station 48. During this removal, the mutual position of the guide rails 51,52 is again slightly altered so that when the packing container approaches the final folding station the corner lugs form an angle with the underlying surface which is less than 45°. In this manner unnecessary cooling of the heated surfaces during the removal of the packing container to the final folding station is prevented.

Figure 11:
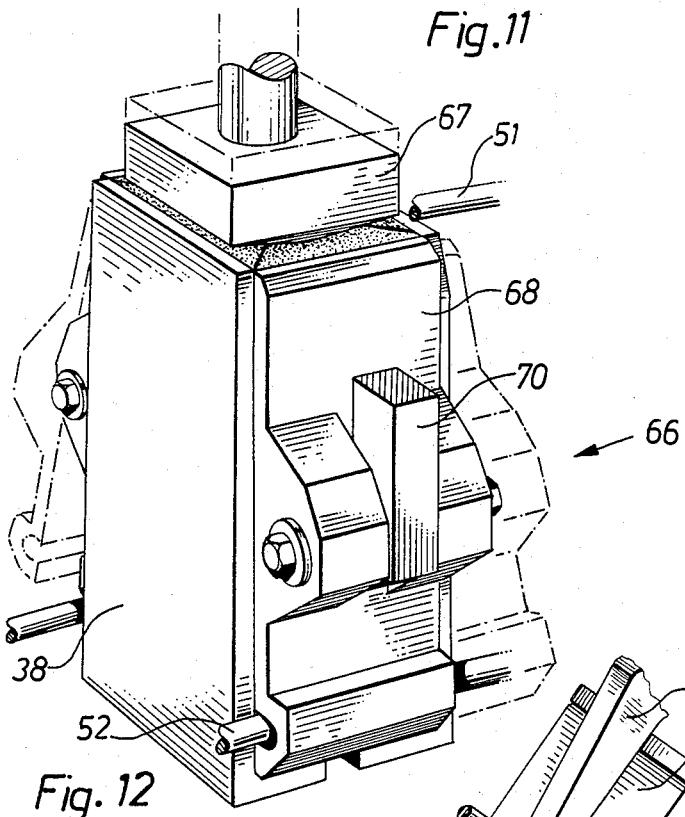

During the removal of the packing container to the final folding station 48, the lateral pressure device 66 and the bottom pressure device 67 of the final folding assembly 65 are clear of the path of movement of the holding device so as not to engage in an obstructing manner with the projecting corner lugs 79,80 of the packing container. After the packing container has been placed in correct position in the final folding station by the holding device 37, the lateral pressure device as well as the bottom pressure device are successively made to lie against the sidewalls and the bottom respectively of the packing container. The pressure plates 68 of the lateral pressure device 66, as long as they are not acted upon by external forces, are oriented so in relation to the lever arms 70, that they are first made to lie against the sidewalls of the packing container at their ends situated towards the bottom of the packing container. Thereupon, on continued pivoting of the lever arms to their active position, the pressure plates 68 are successively swung around the connecting element 71 until they are parallel with each other and rest against the free sidewalls of the packing containers. Through "oblique positioning" of the pressure plates 68 in rest position, the length of stroke of the lever arms can be minimized, since the ends of the pressure plates situated at the top lugs are given in rest position a relatively greater distance to the packing container, so that the corner lugs 79 can be accomodated without difficulty. The relative position of the two pressure plates 68 and the bottom pressure device 67 is illustrated in FIG. 11, where the position of the pressure plates 68 is the instant when they first make contact with the lateral surface of the packing container is illustrated by dash-dotted lines. Thanks to this flexible suspension of the pressure plates 68, they will automatically adopt the correct position in relation to the lateral surfaces of the packing container, so that any risk of damage or deformation of the packing container is appreciably reduced. When the lateral pressure device as well as the bottom pressure device have been brought into correct position, they form together with the jaws and base of the holding device a substantially closed parallelepipedic space, whose inside dimensions correspond to the desired dimensions of the finished packing container. The packing container is allowed to remain in this position until the thermoplastic layer has solidified again and the sealing has been completed.

Figure 12:
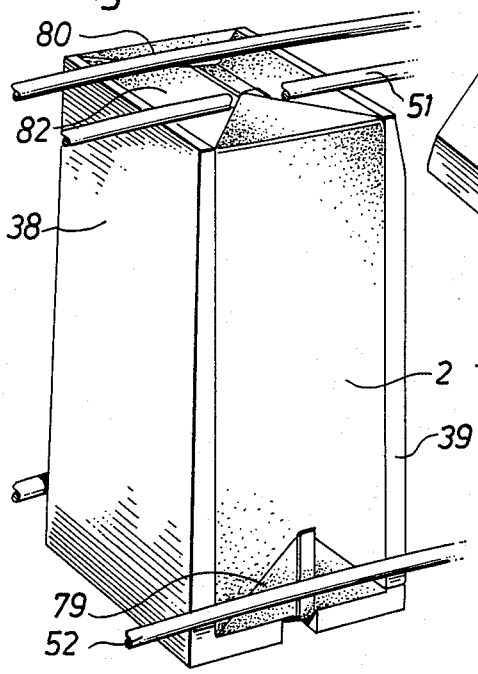

The packing container is then removed through a renewed turning of the means of transport 35 by 1/6th turn to the stand-by station 49. Although the stand-by station 49 is not utilized in this embodiment, it may be used, for example, for the application of reinforcing cardboard discs on one or more of the free surfaces of the packing container (FIG. 12). Renewed turning of the means of transport 35 conveys the holding device 37 with the packing container concerned to the feeding-out station 50. During the turning from the stand-by station 49 the cam follower 43 of the movable jaw 39 gradually runs out into the portion of the cam 44 where the radius is greatest, that is to say where the holding device is opened. In spite of this, however, the packing container is retained in its position in the holding device with the help especially of the two outer guide rails 51 against which the bottom of the packing container slides during the removal to the feeding-out station.

Figure 13:
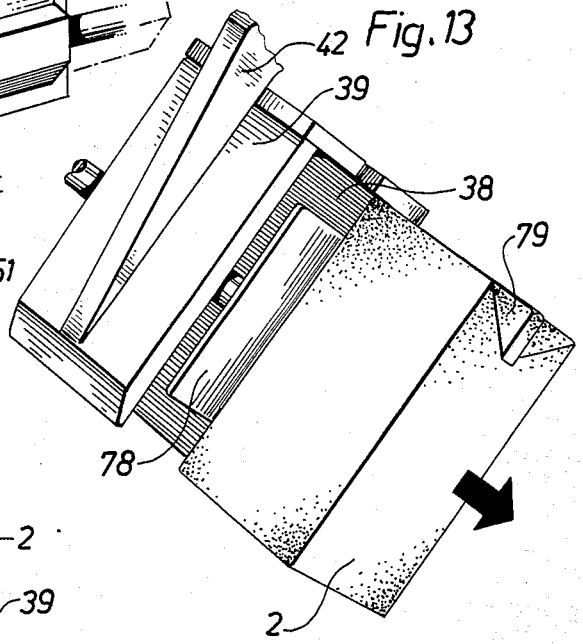

In the feeding-out station (FIG. 13) the pressure plates 78 of the reciprocating feeding-out device 34 are moved in between the two jaws 38,39 of the holding device and push the unfastened packing container in lateral direction out of the holding device 37 up to the sliding surface (not shown) arranged outside the means of transport 35 along which the packing container slides down to the conveyor 8. Finished packing containers are thus fed-out alternately from the two means of transport 35 of the final folding unit 5 and transferred to the conveyor so as to be transported away.

As mentioned before, an alternative embodiment of the machine in accordance with the invention is provided with an assembly for the application of adhesive in place of the hot-air assembly 62 shown in the figure. This variant is applicable even if the machine in accordance with the invention is used for the final shaping of packing containers made of a material which is not covered with an outer thermoplastic layer. The attachment of the corner lugs to the side walls of the packing container is achieved in this case with the help of thermoplastic glue which is applied underneath the corner lugs before these are pressed against the walls of the packing container.

The embodiment of the machine in accordance with the invention, including rotating means of transport which by an indexing movement moves the packing containers between the different processing stations, guarantees a safe removal of the packing containers between accurately fixed positions at each processing station. This wholly eliminates the risk of deformation of the packing containers because of faulty placing of the same in relation to the processing tools. Moreover, since all the co-operating movable elements of the machine, that is to say the means of transport, the different processing stations, the feed assembly etc. are driven from a common source of power and are mechanically connected with each other via the driving assembly, the synchronization between the different movements cannot be lost in normal operation. Hence the machine can also operate at high speed without any risk of faulty processing which ensures high production capacity. This is further enhanced through the utilization of double means of transport which alternately process the incoming packing containers.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing specification should be considered exemplary in nature and not as limiting to the scope and spirit of the invention as set forth in the appended claims.

I claim:

1. A machine for processing packing containers having corner lugs extending from the bottom and top of said containers, said machine comprising:

a first processing station for prefolding the corner lugs on each packing container, comprising a bottom corner lug folding plate for engaging the bottom of the containers and a pair of top corner lug folding plates, a supporting arm for supporting the plates;

a second processing station including nozzle means for applying adhesive means to the corner lugs for adhering the corner lugs to the container;

a third processing station for finally folding the corner lugs, comprising two co-operating lateral pressure plates and a bottom pressure plate, the three pressure plates being synchronously movable between a working and a non-working position; and a container transport device which transports the packing containers between the processing stations, including:

a selectively rotating drum which rotates in incremental steps, a plurality of holding means operably attached to the outer periphery of the drum and spaced around the periphery of the drum for holding said containers, wherein the processing stations are spaced around the periphery of the drum and wherein the spacing of the processing station coincides with the spacing of the holding means whereby the holding means are indexable from one processing station to the next;

radially outer guide rails extending along the path of said holder means, said radially outer guide rails being positioned on opposite sides of said holding means at said first station; and radially inner guide rails extending along the path of travel of said holder means, said radially inner guide rails being positioned on opposite sides of said holding means at said first station;

drive means for radially moving said supporting arm to synchronously move the corner lug folding plates radially between a working position and a non-working position so that the motion of said bottom corner lug folding plate pushes a respective packing container into the holder element between said inner and outer guide rails so as to urge the bottom lugs against the radially outer guide rails and the top lugs against the radially inner guide rails to thereby radially outwardly prefold the bottom and top corner lugs.

2. The machine of claim 1 wherein each holding means comprises a pair of said clamping means extending substantially radially in relation to the selectively rotating means which includes a drum, and wherein each clamping means includes one jaw, one of the pair of jaws being firmly connected to the periphery of the drum and the other of the pair of jaws being supported so that it can pivot about an axle extending parallel with the center axle of the drum.

3. The machine of claim 2, wherein the pivotable jaw constitutes one arm of a lever, the other arm of the lever being engaged with said means for opening and closing said holding means which opening and closing means includes a radial cam, and wherein the cam is firmly connected to a frame of the machine and is located in the central part of the drum.

4. The machine of claim 2 wherein the height of the holding means corresponds to the height of a processed packing container.

5. The machine of claim 3, wherein the cam is of such a shape that the holding means are open while they are at the feeding-in and feeding-out stations, are closed while they are at the adhesive and final folding stations and are partly open at the prefolding station.

6. The machine of claim 5, wherein the outer guide rails extend substantially from the feeding in station and past the prefolding station, the distance between the outer guide rails and the base surfaces of the holding means being increased successively, seen in the direction of movement of the holding means, from a distance which is smaller than the height of the holding means to a distance which, at a level with the prefolding station, is greater than the height of the holding means.

7. The machine of claim 6, wherein the final folding station comprises two co-operating lateral pressure devices and bottom pressure device which three devices are driven by a common source of drive.

8. The machine of claim 7, wherein each lateral pressure device is adapted so as to be moved into the active position resting against opposite lateral surfaces of a packing container with the help of armed levers which via intermediate links are connected to an axially movable operating rod for the bottom pressure device.

9. The machine of claim 7, wherein the lateral pressure device comprise pressure plates which via flexible connecting elements are supported by pivotable lever arms.

10. The machine of claim 9, wherein the pressure plates are so oriented in relation to the lever arms that on pivoting of the lever arms from passive to active position the pressure plates are first made to lie against the sidewalls of each packing container at its end situated towards the radially outwardly positioned surface of each packing container, and wherein the pressure plates are adapted so that on continued pivoting of the lever arms to the active position the pressure plates pivot against the effect of the flexible connecting element until they are mutually parallel and rest against the free sidewalls of the packing container.

11. The machine of claim 7 wherein the jaws of each holding means together with the lateral and bottom pressure devices of the final folding station in their active position enclose a parallelepipedic space, the size and shape of which correspond to the size and shape of the finished packing container.

12. The machine of claim 1 wherein the transport means, the bottom folding plate, a lateral and a bottom pressure device and a feed assembly for the transport means are mechanically coupled together and are driven via a common source of power and wherein the transport means are supported by a common shaft which is driven via an indexing gear by the common source of power.

13. The machine of claim 1 wherein each holding means includes a pair of jaw members extending substantially radially outwardly from the drum, a first jaw member of each pair being fixedly attached to the drum and a second jaw member of each pair being pivotably attached to the drum.

14. The machine of claim 1 further comprising feeding means for feeding packing containers to the container transport device and transfer means for transferring the processed packing containers away from the container transport device.

15. The machine of claim 1 wherein two laterally spaced sets of processing stations, container transport devices and inner and outer guide rails are provided, and wherein:

a reciprocating feeding means for alternately feeding unprocessed packing containers to one or the other of the two laterally spaced container transport devices; and reciprocating transfer means for alternately transferring processed packing containers from the two laterally spaced container transport devices.

16. The machine of claim 14 wherein a common drive assembly synchronously drives the transport device, the feeding means, the transfer means, the first processing station and the third processing station.

17. The machine of claim 15 wherein a common drive assembly drives the container transporting device, the feeding means and the transfer means.

18. A machine for forming parallel-piped packing containers from packing container blanks having ends with sealing fins and corner lugs, said machine comprising:

a rotatable drum having a plurality of openable holder elements spaced around the periphery of the drum;

drive means for intermittently rotating said drum from one angular station to another;

means for successively inserting individual container blanks into said holder elements at a first angular station;

radially outer guide rails extending beyond the first angular station along the path of said holder elements, said outer guide rings mounted at a radially increasing distance from the center of the drum from said first angular station to a second angular station to engage the corner lugs at the end of the inserted packing blank furthest from the center of said drum and raise the packing blank from the respective holder element;

radially inner guide rails extending beyond the first angular station along the path of travel of said holder elements, said inner guide rings being positioned to engage the corner lugs at the other end of the inserted packing blank, wherein each said inner and outer guide rails are positioned on opposite sides of said holding means at said first station;

a prefolding processor at said second angular station, said prefolding processor comprising a folding plate and synchronized drive and linkage means for reciprocatingly moving said folding plate toward and away from the center of the drum when a holder element has arrived at said second angular station, to push the raised packing blank back into the holder element between said inner and outer guide so as to urge the bottom lugs against the radially outer guide rails and the top lugs against the radially inner guide rails to thereby radially outwardly fold the corner lugs; and means for opening and closing said holder elements such that said holder elements are open at said first station and at least partially open at said second station.

19. The machine as claimed in claim 18 wherein said prefolding processor further comprises additional folding plates connected to said synchronized driving means, said inner rails causing the lugs at said other end of the inserted packing blank to be folded around ends of said additional folding plates.

20. The machine as claimed in claim 19 wherein said machine further comprises a guide plate positioned between said first and second angular stations such that said inner and outer guide rails urge said packing blank against said guide plate to thereby fold said sealing fins.

21. The machine as claimed in claim 20 wherein said outer guide rails at said first station are situated closer to the center of said drum than the furthest removed end of the holding elements and at said second station are situated at a further from the center of the drum than the furthest removed end of the holding elements.

22. The machine as claimed in claim 18 wherein said openable holder element comprises a first jaw fixed to said drum and a pivotable jaw secured to said drum about an axle extending parallel with respect to the axis of said drum, and said means for opening and closing said holder element comprises a lever arm extending from said pivotable jaw, a cam follower at an end of said lever arm and a radial cam which cooperates with said cam follower as said holder element rotates with said drum.

23. The machine as claimed in claim 18 wherein said machine further comprises:

nozzle means at a third angular station for applying adhesive medium to the corner lugs for adhering the corner lugs to sides of the packing blank;

a final folding processor at a fourth angular station for finally folding the corner lugs against sides of the packing blank; and means at a final angular station for transferring processed packing blanks from said drum.

24. The machine as claimed in claim 23 wherein said openable holder element comprises a first jaw fixed to said drum and a pivotable jaw secured to said drum about an axle extending parallel with the axis of said drum, and said means for opening and closing said holder elements comprises a lever arm extending from said pivotable jaw, a cam follower at an end of said lever arm and a radial cam which cooperates with said cam follower as holder element rotates with said drum, said means for opening and closing said holder elements maintaining said holder elements in a closed condition at said third and fourth angular stations.

25. The machine as claimed in claim 23 wherein said final folding processor comprises an end pressure plate, lateral pressure plates, and synchronized drive and linkage means for reciprocatingly moving said end pressure plate radially inward against the end of a respective, inserted packing blank which is furthest from the center of the drum and for simultaneously moving said lateral pressure plates against opposing lateral sides of said inserted packing blank.

26. The machine as claimed in claim 25 wherein said end pressure plate, said lateral pressure plates and said jaws define the desired parallelpiped shape.

27. The machine as claimed in claim 26 wherein said drive and linkage means comprises a radially extending shaft connected to said end plate and means for axially reciprocating said shaft when a holder element arrives at said fourth station.

28. The machine as claimed in claim 27 wherein said linkage and drive means further comprises for each lateral pressure plate a pivotable member connected at one end to the respective lateral pressure plate and connected at the other end to a toggle connection with said shaft, said pivotable member including an axle fixed in position at said fourth station, said pivotable member pivoting about said axle when said shaft reciprocates to thereby reciprocably bring the respective lateral pressure plate into position against the respective side of the packing blank.

29. The machine as claimed in claim 28 wherein said connection between one end of the pivotable member and the lateral pressure plate comprises rubber grommets so that the lateral pressure plate contacts the respective lateral sides of the packing blank first at said other end of the packing blank.

30. The machine as claimed in claim 29 wherein said lateral pressure plates include grooves for accommodating said guide rails.

31. The machine as claimed in claim 14 wherein said machine further comprises:

first conveyor means for conveying unprocessed packing containers to said feeding station; and second conveyor means for conveying processed packing containers away from said final station.

32. The arrangement of claim 31 wherein the first conveyor means includes:

a first, downwardly sloping, conveyor for receiving unprocessed containers;

a second, upwardly sloping, conveyor for receiving the unprocessed containers from the first conveyor, and a third conveyor positioned above an exit end of the second conveyor, the third conveyor having at least one projecting finger for contacting each container and increasing the speed with which that container exits the second conveyor.

33. The arrangement of claim 32 wherein the first and second conveyors share a common end pulley between them.

* * * * *